US007010251B2

(12) United States Patent
Yamauchi et al.

(10) Patent No.: US 7,010,251 B2
(45) Date of Patent: Mar. 7, 2006

(54) TONER CONVEYANCE DEVICE AND IMAGE FORMING APPARATUS EQUIPPED THEREWITH

(75) Inventors: Kazumichi Yamauchi, Hachioji (JP); Ritsuo Fujii, Hachioji (JP); Satoshi Sakata, Hino (JP); Seiji Yamaguchi, Hino (JP); Hiroshi Isokawa, Hino (JP); Hiroyuki Watanabe, Hachioji (JP); Yasuo Shiokawa, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 85 days.

(21) Appl. No.: 10/723,819

(22) Filed: Nov. 24, 2003

(65) Prior Publication Data

US 2004/0105704 A1 Jun. 3, 2004

(30) Foreign Application Priority Data

Dec. 2, 2002 (JP) ..... 2002-349678
Dec. 3, 2002 (JP) ..... 2002-351153

(51) Int. Cl.
*G03G 15/08* (2006.01)

(52) U.S. Cl. ..... 399/258

(58) Field of Classification Search ..... 399/53, 399/222, 252, 258, 262, 292
See application file for complete search history.

(56) References Cited

U.S. PATENT DOCUMENTS 5,799,227 A * 8/1998 Matheis et al. ..... 399/292 X
5,909,609 A * 6/1999 Yahata et al. ..... 399/258
5,915,154 A * 6/1999 Schoch et al. ..... 399/258
5,950,055 A * 9/1999 Yahata et al. ..... 399/252
5,953,567 A * 9/1999 Muramatsu et al. .... 399/258 X
6,524,762 B1 * 2/2003 Tsutsui et al. ..... 399/252 X
6,560,429 B1 * 5/2003 Bares et al. ..... 399/258 X
6,597,883 B1 * 7/2003 Muramatsu et al. ..... 399/258

FOREIGN PATENT DOCUMENTS

| | | |
|---|---|---|
| JP | 07-219329 | 8/1995 |
| JP | 10-097130 | 4/1998 |
| JP | 10-268641 | 10/1998 |
| JP | 10-299672 | 11/1998 |

* cited by examiner

*Primary Examiner*—Sandra L. Brase
(74) *Attorney, Agent, or Firm*—Frishauf, Holtz, Goodman & Chick, P.C.

(57) ABSTRACT

A toner conveyance device for conveying toner particles including: a toner mixing unit having a toner introducing portion to introduce toner particles, for mixing the toner particles from the toner introducing portion with air to make a toner fluid; a first conveyor for receiving the toner fluid in the toner mixing unit and conveying; a toner separation unit for separating the toner fluid conveyed by the first conveyor into air and toner particles, the toner separation unit having a toner discharging portion for discharging the separated toner particles to an outside; a second conveyor for conveying the air separated by the toner separation unit back to the toner mixing unit; and a tightly closed circulation path of air, formed starting at the toner mixing unit which leads to the toner separation unit through the first conveyor and returning back to the toner mixing unit through the second conveyor.

23 Claims, 10 Drawing Sheets

TONER CONVEYANCE DEVICE AND IMAGE FORMING APPARATUS EQUIPPED THEREWITH

BACKGROUND OF THE INVENTION

This invention relates to a toner conveyance device and an image forming apparatus of an electrophotographic method having the toner conveyance device.

In a high-speed image forming apparatus or a color image forming apparatus, because the capacity of the toner storage unit for storing the toner is large, there is a problem that it sometimes happens a case where it is difficult to dispose the toner storage unit in the neighborhood of the development device.

As regards means for solving such a problem, it has been developed a toner supply technology in which toner particles are conveyed from the toner storage unit to the development device by a toner conveyance method called an air conveyance method which is capable of conveying toner particles to a distant place.

The basic structure of a toner supply device using an air conveyance method is composed of a toner mixing portion for mixing toner particles with air, a conveyance means for conveying a toner fluid produced by the mixing of toner particles with air in the toner mixing portion, and a toner separation portion for separating toner particles from the conveyed toner fluid.

However, in a conventional toner conveyance technology, when a mix fluid of toner particles and air is conveyed from the toner storage unit to the development device by a fluid conveyance means such as a pump, air is introduced into the toner mixing portion from the outside, and after the fluid is further separated into toner particles and air in the toner separation portion, the air is discharged through a filter to the outside. Accordingly, because an extra energy for introducing air into the device and further discharging the air to the outside of the device is required for the pump, it has been difficult to make the toner conveyance distance long. Besides, for the reason that the filter comes to clog up with toner particles or the like, there has been a problem that a stable toner conveyance cannot be practiced.

Further, most of the device has a structure such that the fluid flows back to the aforesaid fluid conveyance means without discharging a part of the air separated from the toner particles to the outside. Further, in the toner separation portion, there is provided a filter for not scattering toner particles to the outside, by which only a part of the air is made to flow to the outside to carry out the air pressure adjustment in the conveyance path (for example, the Japanese publications of the unexamined patent applications H7-219329, H10-97130, H10-268641, and H10-299672).

In a conventional technology, because a mix fluid of toner particles and air is conveyed to a toner separation portion disposed at a sufficiently distant position from a toner storage unit by a fluid conveyance means made up of a pump for conveying the mix fluid, the toner conveyance performance is not sufficient, and a poor conveyance sometimes occurs. For that reason, it is necessary to make the pump large-sized; however, if the pump is made large-sized, the amount of exhaust to the outside through the filter provided in the toner separation portion becomes large, which increases the toner quantity adhering to the filter to cause the filter to clog up earlier, and it results in toner scattering and requires a troublesome operation such as the replacement of the filter at the time of a periodical maintenance.

SUMMARY OF THE INVENTION

This invention has been made in view of the above-mentioned problems, and it is the first object of this invention to provide a toner conveyance device capable of carrying out a long-distance conveyance of toner stably over a long period of time and an image forming apparatus using the toner conveyance device.

It is the second object of this invention, for the purpose of solving the above-mentioned problems in the toner conveyance technology using a conventional air conveyance method, to provide a toner conveyance device having an improved maintenability requiring no filter replacement by it that a filter which is in direct contact with the outside air is removed, the toner conveyance end is made to be a closed space, and the pressure of the whole of the air circulation system is kept constant to the utmost by the practice of the rotation control of the pump motor.

The first object of this invention can be accomplished by any one of the structures (1) to (8) described below.

(1) A toner conveyance device for conveying toner particles comprising at least a toner mixing unit, a toner separation unit, a first conveyance means, and a second conveyance means, characterized in that said toner mixing unit comprises a toner introducing portion for introducing toner particles and mixes the toner particles introduced from said toner introducing portion with air to make a toner fluid, said first conveyance means conveys the toner fluid produced in said toner mixing portion from there to said toner separation unit, said toner separation unit separates the toner fluid conveyed by said first conveyance means into air and toner particles and further comprises a toner discharging portion for discharging said toner particles to the outside, said second conveyance means conveys the air separated by said toner separation unit from there to said toner mixing unit, and it is formed a tightly closed circulation path of air starting from said toner mixing unit leading to said toner separation unit through said first conveyance means and returning to said toner mixing unit again through said second conveyance means.

(2) A toner conveyance device as set forth in the structure (1) characterized by further comprising a control means for detecting the conveyance amount of the toner fluid of the aforesaid first conveyance means and controlling the conveyance amount of the air of the second conveyance means on the basis of said conveyance amount of the toner fluid.

(3) A toner conveyance device as set forth in the structure (2) characterized by the aforesaid control means detecting the conveyance amount of the toner fluid of the aforesaid first conveyance means and practicing a control to make constant the ratio of said conveyance amount to the conveyance amount of the air of the aforesaid second conveyance means.

(4) A toner conveyance device as set forth in the structure (2) characterized by the aforesaid control means detecting the conveyance amount of the toner fluid of the aforesaid first conveyance means, and if said conveyance amount is not greater than a target conveyance amount, practicing a control to increase the conveyance amount of the air of the aforesaid second conveyance means.

(5) A toner conveyance device as set forth in the structure (2) characterized by the aforesaid control means detecting the conveyance amount of the toner fluid of the aforesaid first conveyance means, and if said conveyance amount is not greater than a target conveyance amount, practicing a control to stop said first conveyance means and the aforesaid second conveyance means.

(6) A toner conveyance device as set forth in the structure (2) characterized by further comprising a warning means for making a warning, the aforesaid control means detecting the conveyance amount of the toner fluid of the aforesaid first conveyance means, and if said conveyance amount is not greater than a target conveyance amount, practicing a control to make a warning by said warning means.

(7) A toner conveyance device as set forth in any one of the structures (2) to (6) characterized by the aforesaid control means practicing a control of the toner introduction amount of the aforesaid toner introducing portion on the basis of the conveyance amount of the toner fluid of the aforesaid first conveyance means.

(8) An image forming apparatus characterized by comprising a toner conveyance device as set forth in any one of the structures (1) to (7).

The above-mentioned second object can be accomplished by either one of the structures (9) and (10) described below.

(9) A toner conveyance device which conveys a mix fluid of toner particles and air from a toner storage unit to a toner separation unit by a fluid conveyance means for toner supply (referred to also as a first conveyance means), separates the toner particles and the air in said toner separation unit, conveys the toner particles from said toner separation unit to a development device, and comprises a fluid conveyance means for circulating toner particles (referred to also as a second conveyance means) for making a mix fluid of the residual toner particles which have not been separated and the air from said toner separation unit to said toner storage unit, characterized in that the toner supply path and the toner circulation path are tightly closed against the outside air, and the number of rotations of the pump motors making up the fluid conveyance means for toner supply and that making up the fluid conveyance means for toner circulation are detected and controlled.

(10) A toner conveyance device which conveys a mix fluid of toner particles and air from a toner storage unit to a toner separation unit by a fluid conveyance means for toner supply, separates the toner particles and the air in said toner separation unit, conveys the toner particles from said toner separation unit to a development device, and comprises a fluid conveyance means for circulating toner particles for making a mix fluid of the residual toner particles which have not been separated and the air from said toner separation unit to said toner storage unit, characterized in that each of the conveyance means comprises a conveyance path of toner particles, at least a part of each conveyance path is formed of a flexible pipe made of resin or rubber, a member made of metal is wound round the outer surface of at least a part of said pipe, and said member is grounded.

DETAILED DESCRIPTION OF THE PREFERRED EMBODIMENT

Figure 1:
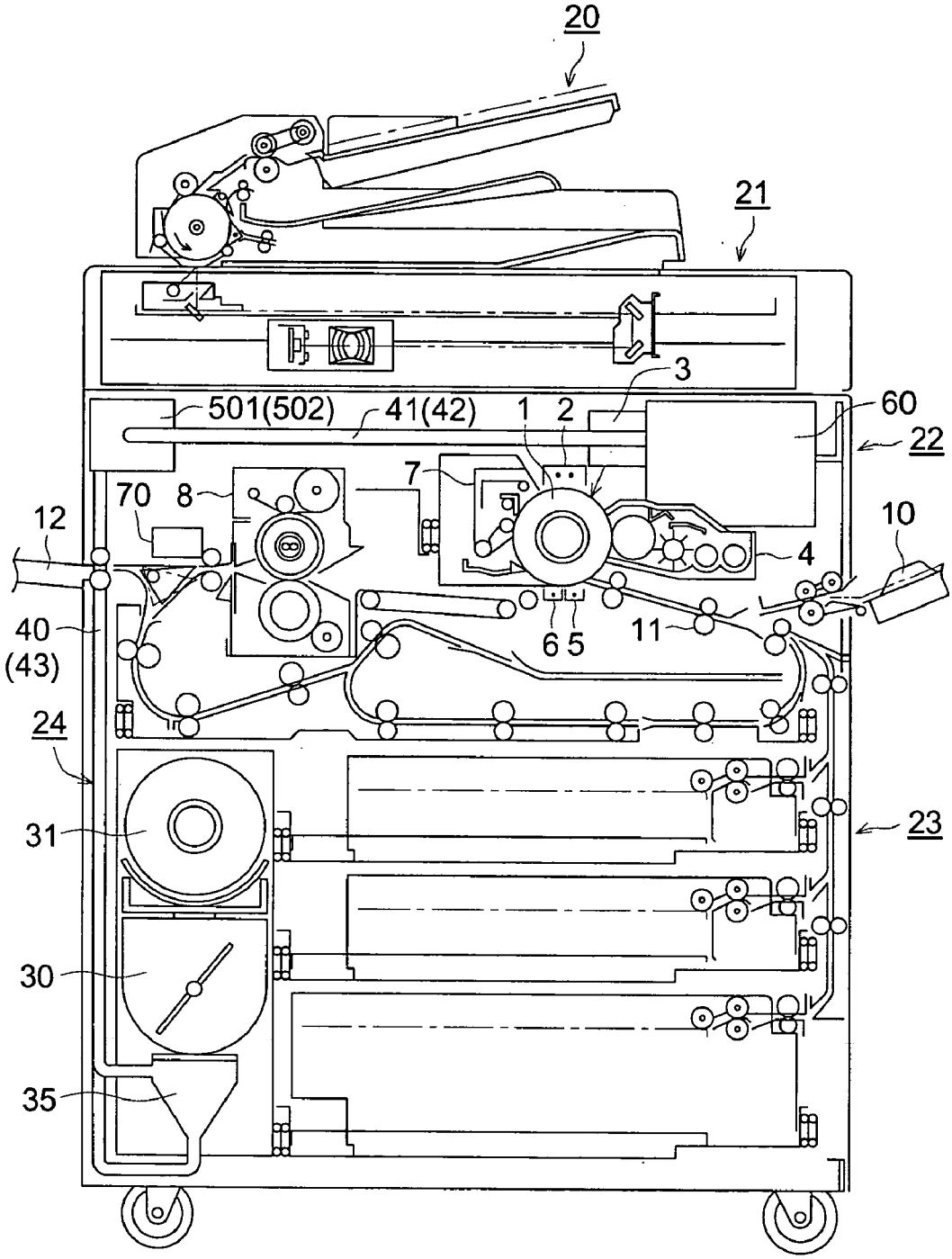
FIG. 1 is a drawing showing an example of an image forming apparatus comprising a toner conveyance device of this invention.

In FIG. 1, an example of an image forming apparatus comprising a toner conveyance device of this invention is shown.

In FIG. 1, an automatic document feeder 20 conveys document sheets stacked on a document feed table one by one to a reading position, and stacks the document sheets after being read on a document ejection tray.

A document reading section 21 reads an image on a document sheet to generate digital image data. An image forming section 22 forms an image on a recording sheet by an electrophotographic method.

In the image forming section 22, there are arranged around a drum-shaped photoreceptor 1 a charging device 2, an exposure device 3, a development device 4, a transfer device 5, a detachment device 6, and a cleaning device 7. Under the image forming section 22, there is provided a sheet feed section 23 equipped with a plurality of recording sheet accommodating units, which feeds a recording sheet to the image forming section. The sign 10 denotes a manual sheet feed unit. A recording sheet fed from the sheet feed section 23 or the manual sheet feed unit 10 is supplied to a gap between the photoreceptor 1 and the transfer device 5 by a pair of registration rollers 11, is subjected to a fixing processing in a fixing device 8, and is ejected onto an ejection tray 12.

With the rotation of the photoreceptor 1 clockwise, through charging by the charging device 2, image exposure by the exposure device 3, and development by the development device 4, a toner image is formed on the photoreceptor 1. The toner image formed is transferred to a recording sheet by the transfer device 5. The recording sheet, having the toner image transferred on it, is subjected to a fixing processing in the fixing device 8, and then, is ejected onto the ejection tray 12.

The development device 4 develops an electrostatic latent image on the photoreceptor 1 with a two-component developer containing a toner and a carrier or a single-component developer containing a toner and an additive. The toner consumed by development in the development device 4 is replenished by means of a toner conveyance device 24 of this invention from a toner container 31 and a toner hopper 30, and the toner concentration of the developer in the development device 4 is always maintained at a specified value.

The toner conveyance device shown in FIG. 1 is explained in detail with reference to FIG. 2.

Figure 2:
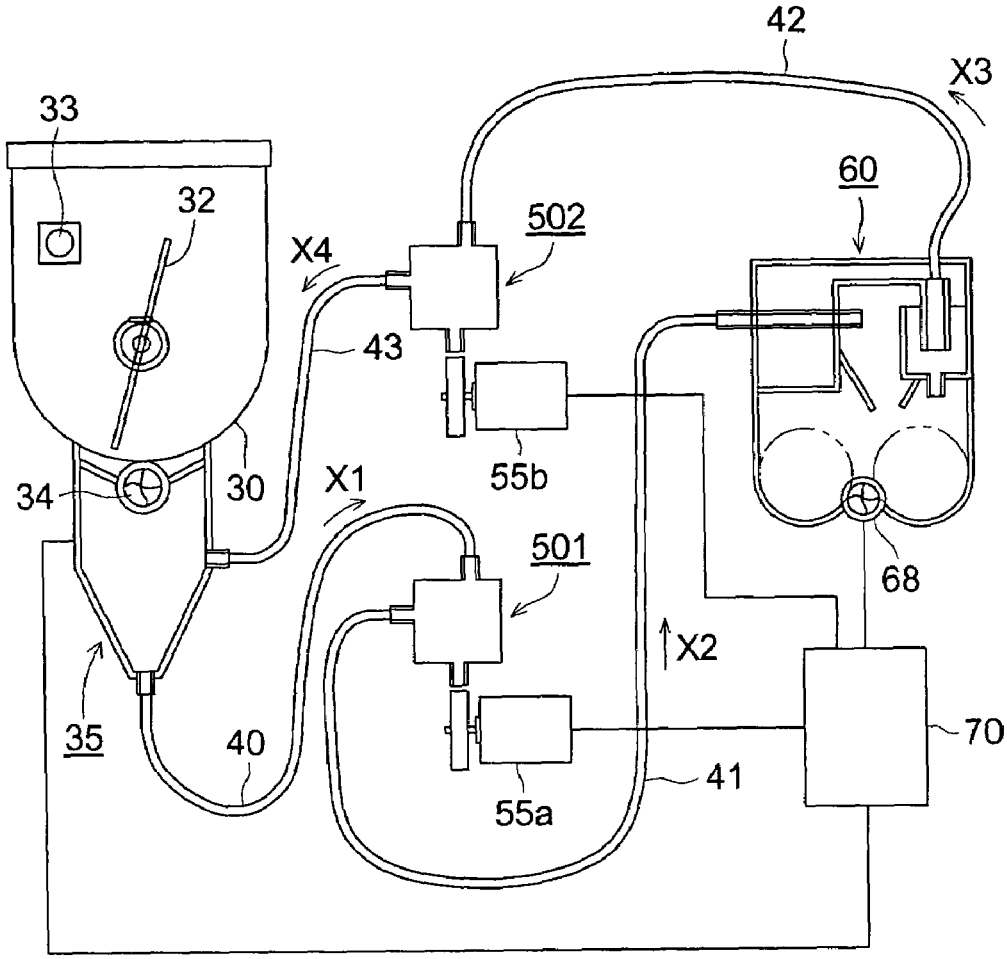
FIG. 2 is a drawing showing an example of the first embodiment of a toner conveyance device of this invention.

FIG. 2 is a drawing showing an example of the first embodiment of a toner conveyance device of this invention.

The toner conveyance device shown in FIG. 2 comprises a toner mixing room 35 which is a toner mixing unit of this invention, a pump 501 which is a first conveyance means of this invention, conveyance pipes 40 and 41, a pump 502 which is the second conveyance means of this invention, conveyance pipes 42 and 43, a toner separation room 60 which is a toner separation unit of this invention, and a control section 70 which is the control means of this invention. The toner mixing room 35 has a toner introduction inlet 34 that is a toner introduction portion of this invention, and the toner separation room 60 has a toner discharge outlet 68 that is a toner discharge portion of this invention.

As shown in FIG. 2, the toner mixing room 35, the pumps 501 and 502, and the toner separation room 60 are connected to one another by the conveyance pipes 40, 41, 42, and 43.

Toner particles are introduced from the toner hopper 30 having a stirring member 32 and a toner sensor 33 using a piezoelectric element to the toner mixing room 35 through the toner introduction inlet 34, are mixed with air to become a toner fluid, which is conveyed by the pump 501, as shown by the arrow mark X1, from the toner mixing room 35 to the pump 501, and is further conveyed, as shown by the arrow mark X2, from the pump 501 to the toner separation room 60; thus, toner supply is made to the toner separation room 60. Subsequently, the air separated from the toner fluid is circulated by the pump 502, as shown by the arrow mark X3, from the toner separation room 60 to the pump 502, and further flows back, as shown by the arrow mark X4, from the pump 502 to the toner mixing room 35. Then, the toner particles separated in the toner separation room 60 are supplied to the development device 4 through the toner discharge outlet 68.

The toner conveyance device has a tightly closed structure that makes it impossible for toner particles and air to pass except through the toner introduction inlet 34 and toner discharge outlet 68. Further, as will be described later, as regards the toner introduction inlet 34 and the toner discharge outlet 68 too, they have a structure such that the introduction and discharge of toner particles can be carried out without changing the pressure in the air flowing path of the device.

In this invention, the term "tightly closed circulation path of air" means a fluid path not having a passage communicating with the outside to change the pressure inside the air flowing path. As regards the term "a passage communicating with the outside to change the pressure inside", for example, a filter portion provided in the air flowing path mentioned in a conventional technology is applicable to this.

A toner conveyance device of this invention makes it possible to utilize the energy of the first conveyance means in the conveyance of the toner fluid with a good efficiency and it can make longer the conveyance distance of toner.

The control section 70 controls the number of rotations of each motor of the toner introduction inlet 34, the toner discharge outlet 68, and the pumps 501 and 502, and further, detects the conveyance amount of the toner fluid of the pump 501.

Figure 3:
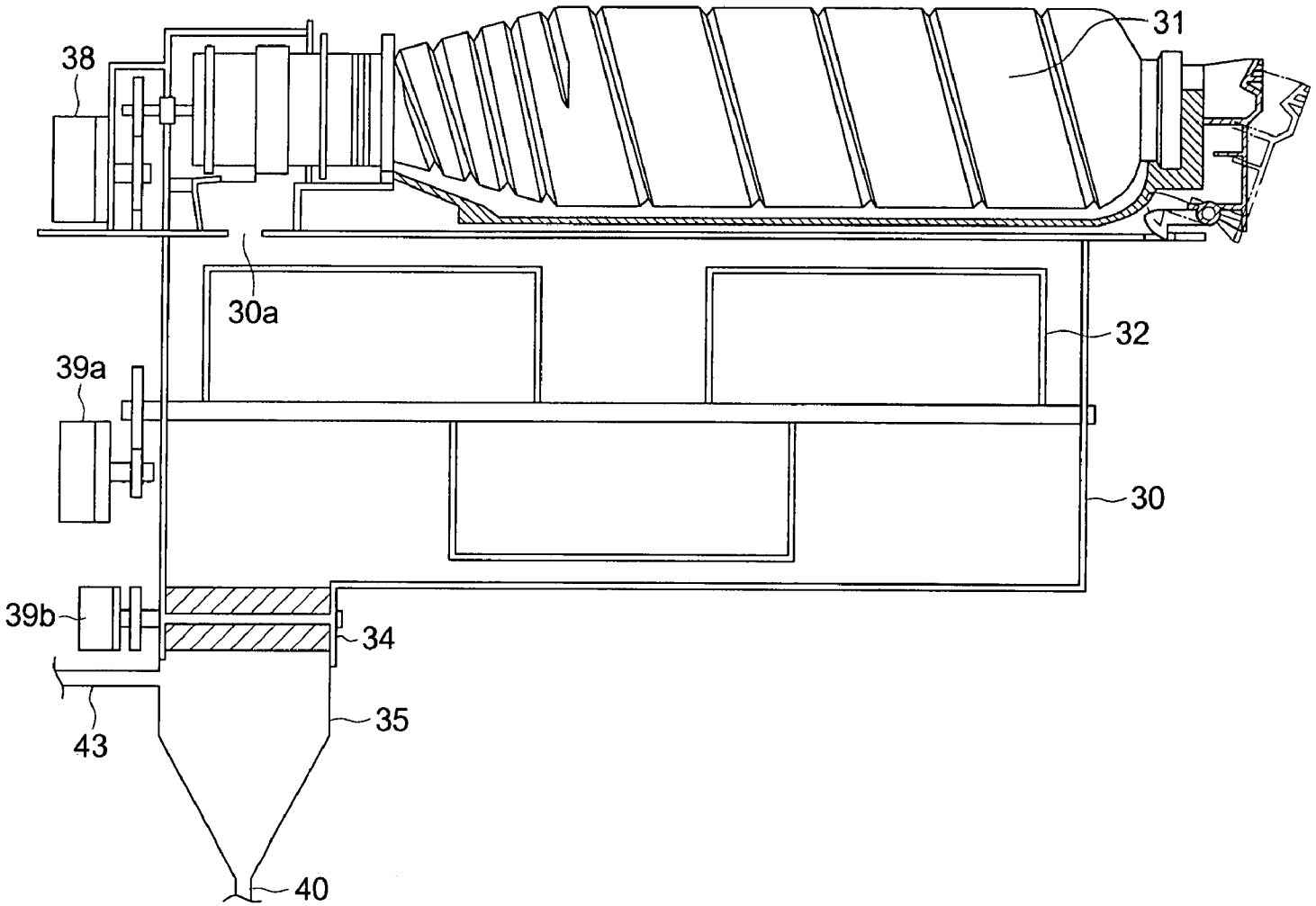
FIG. 3 is a drawing for illustrating an example of the first embodiment of a toner conveyance device of this invention.

With reference to FIG. 3, the toner mixing room 35 of a toner conveyance device of this invention will be further explained.

The toner mixing room 35 is fitted with the cylindrical toner container 31 and the toner hopper 30, and by the rotational driving of the toner container 31 by the motor 38, toner particles drop from the toner container 31 into the toner hopper 30 through an opening 30*a*.

A bar-shaped stirring member 32 having a plurality of U-shaped portions formed is provided in the toner hopper 30. The stirring member 32 is rotated by the rotation of a motor 39*a* to make toner particles drop from the toner hopper 30 to the toner introduction inlet 34 of the toner mixing room 35. Further, a screw known to the public (not shown in the drawing) is provided in the toner hopper 30. By the rotation of this screw, the whole of the toner particles in the toner hopper 30 are conveyed toward the toner introduction inlet 34. The toner introduction inlet 34 has a structure of a rotary door shape, and a prescribed amount of toner can be supplied to the inside of the toner mixing room 35 without changing the pressure in the air flowing path.

The toner particles on the toner introduction inlet 34 are introduced into the toner mixing room 35 through the toner introduction inlet being rotated by the rotation of a motor 39*b*. The toner supply amount can be controlled by the number of rotations of the motor 39*b* driving the toner introduction inlet 34.

In the toner mixing room 35, because air is fed in by the pump 502 through the conveyance pipe 43, a toner fluid composed of toner particles mixed with air is formed.

Figure 4:
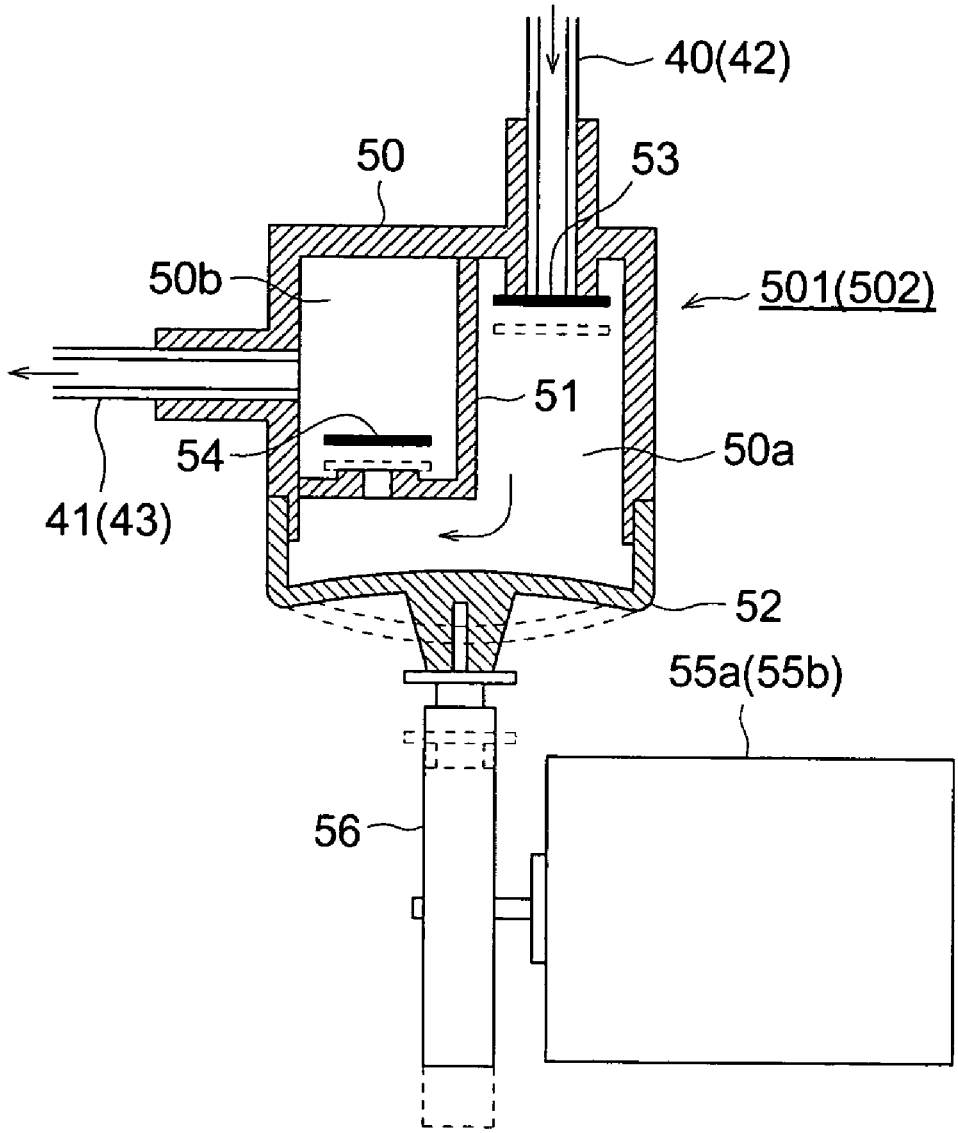
FIG. 4 is a drawing for illustrating an example of the first embodiment of a toner conveyance device of this invention.

With reference to FIG. 4, the pumps 501 and 502 of a toner conveyance device of this invention will be further explained.

As regards the pumps 501 and 502, as shown in FIG. 4, the pumps 501 and 502 made up of a diaphragm pump are used, and an arbitrary pump or a fan known to the public such as a screw pump disclosed in the Japanese publications of the unexamined patent applications H7-219329 and H8-6398 can be also used. The pump 501 and the conveyance pipes 40 and 41 together make up the first conveyance means of this invention for conveying toner fluid composed of toner particles mixed with air from the toner mixing room 35 to the toner separation room 60, and the pump 502 and the conveyance pipes 42 and 43 together make up the second conveyance means of this invention for conveying the air separated from the toner fluid in the toner separation room 60 from the toner separation room 60 to the toner mixing room 35. Further, in the example shown in the drawing, the pumps 501 and 502 having the same structure are used; however, it is also appropriate to use pumps each having a structure different from each other.

The suction inlet of the pump 501 is connected to the conveyance pipe 40, and its discharge outlet is connected to the conveyance pipe 41. The suction inlet of the pump 502 is connected to the conveyance pipe 42, and its discharge outlet is connected to the conveyance pipe 43. The pump room formed of an outer wall 50 is partitioned by a inner wall 51 into a suction room 50*a* and a discharge room 50*b*; a valve 53 is provided at the suction inlet of the suction room 50*a* and a valve 54 is provided at a vent of the discharge room 50*b* (a vent provided in the inner wall 51).

A part of the outer wall of the pumps 501 and 502 is formed of a diaphragm 52 made of an elastic body composed of rubber; the diaphragm 52 is driven by an eccentric rotary member 56 driven by a motor 55*a* (55*b*), and is deformed to be brought in the state shown by the solid line or in the state shown by the dotted line.

The eccentric rotary member 56 is rotated by the motor 55*a* (55*b*), and by this rotation, the diaphragm 52 is deformed between the state shown by the solid line and the state shown by the dotted line to vary the capacity of the suction room 50*a*; thus, it increases and decreases the pressure in the suction room 50*a*. By this increasing and decreasing of the pressure, the valves 53 and 54 are transferred between the state shown by the solid line and the state shown by the dotted line; this lets the fluid flow in one way shown by the arrow mark.

In this invention, its effect can be obtained even by a second conveyance means that is provided with no power source such as the pump 502 but with the conveyance pipes 40 and 41 only. However, in order to convey toner to a longer distance, as will be described later, it is preferable to carry out toner conveyance by utilizing a power source such as a pump for the second conveyance means too.

Figure 5:
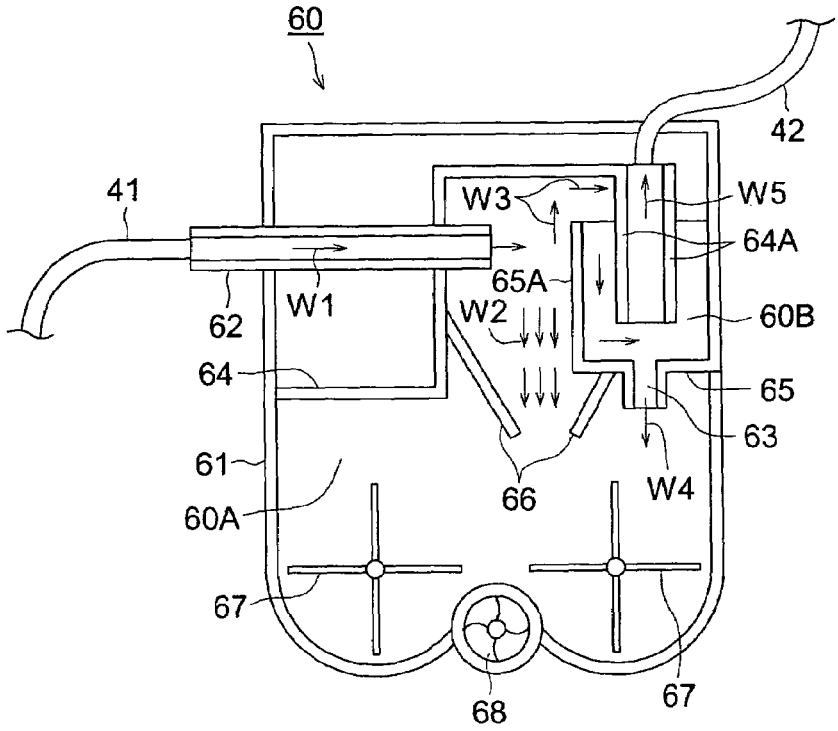
FIG. 5 is a drawing for illustrating an example of the first embodiment of a toner conveyance device of this invention.

With reference to FIG. 5, the toner separation room 60 of a toner conveyance device of this invention will be further explained.

The toner separation room 60 comprises an outer wall 61 forming the outer shell of the toner separation room 60, inner walls 64 and 65 separating the inner space of the toner separation room 60 into an introduction room 60A and a discharge room, and auxiliary walls 66. The discharge room is made up of a discharge portion 60B.

An air inlet 62 is provided in the introduction room 60A, and an air outlet 63 is provided in the discharge portion 60B. The auxiliary walls 66 guide the falling toner particles, and suppress the rising of toner particles. In the lower part of the toner separation room 60, a stirring member 67 having blades and the toner discharge outlet 68 are provided. The toner discharge outlet 68 is provided for the purpose of discharging the separated toner particles to the outside of the toner separation room 60, and in an image forming apparatus, usually they are supplied to the development device 4. The toner discharge outlet 68, in the same way as the toner introduction inlet 34, has a structure of a rotary door, and is capable of supplying specified amount of toner from the toner separation room 60 to the development device 4 without changing the pressure in the air flowing path of the device.

The toner particles accumulated on the toner discharge outlet 68 are discharged to the outside of the toner separation room 60 through the toner discharge outlet 68 being rotated by the rotation of a motor not shown in the drawing. The discharge amount of toner can be controlled by the rotational speed of the motor (not shown in the drawing) driving the toner discharge outlet.

A toner fluid composed of toner particles mixed with air is introduced into the introduction room 60A from the air inlet 62 as shown by the arrow mark W1, and the toner particles drop in a way shown by the arrow marks W2. The introduction room 60A is filled with the toner fluid, which is subject to the pressure caused by the fluid conveyance force of the pump 502, and as shown by the arrow marks W3, a part of the fluid rises, to be conveyed to the discharge portion 60B. Owing to the specific weight of the toner particles and the action of the auxiliary walls 66, the toner concentration of the mix fluid rising in the direction of the arrow marks W3 becomes low, resulting in a toner fluid approximately composed of air only. The toner fluid fed into the discharge portion 60B is further separated into toner particles and air, and the separated toner particles, as shown by the arrow mark W4, drops from a toner passage 63, while the separated air flows back through the conveyance pipe 42 as shown by the arrow mark W5.

As shown in the drawing, the vertical portion 65A of the inner wall 65 and the vertical portion 64A of the inner wall 64 form a through passage for making the toner fluid to meander. By such a meandering through passage, the toner content in the circulating air is made to have a low value. The vertical portions 65A and 64A are cylindrical, and have a structure such that the cylinder of the vertical portion 64A. is arranged in the cylinder of the vertical portion 65A.

The toner conveyance device of this invention shown in FIG. 2 to FIG. 5 operates in the following way by the control of the control section 70.

The toner amount in the toner hopper 30 is detected by the toner sensor 33 using a piezoelectric element, and when the level of the toner pile becomes lower than the level capable of being detected by the toner sensor 33, a motor 38 operates to cause toner to be supplied from the toner container 31 to the toner hopper 30.

In order to convey toner particles to the development device 4, the motor 39*a* shown in FIG. 3 operates to drive the stirring member 32 to stir toner particles in the toner hopper 30, while the motor 39*b* at the toner introduction inlet 34 is driven to introduce toner particles into the toner mixing room 35.

Further, by a toner supply signal, motors 55*a* and 55*b* rotates to actuate the pumps 501 and 502. By the operation of the pumps 501 and 502, an air flow is generated in the mixing room 35 to cause toner particles to be mixed with air, and the toner fluid is conveyed by the conveyance force of the pump 501 through the conveyance pipes 40 and 41 to the toner separation room 60.

The toner particles separated in the toner separation room 60 are supplied from the toner discharge outlet 68 to the development device 4. Further, the separated air is made to flow back to the mixing room 35 through the conveyance pipes 42 and 43 by the conveyance force of the pump 502.

Further, the motor at the toner discharge outlet 68 rotates to supply toner to the development device 4.

In addition, the control of each motor based on a toner supply signal is practiced in the control section 70.

A toner conveyance device of this invention, for example, by the above-mentioned device structure, mixes toner particles with air to produce a toner fluid in the toner mixing unit, and conveys this toner fluid to the toner separation unit by the use of the first conveyance means. Further, it has a structure such that the toner fluid is separated into toner particles and air in the toner separation unit, and the toner particles are supplied to the development device etc., while the air is conveyed to the toner mixing unit to be used again for the mixing with toner particles. The air flowing path is made to be a tightly closed circulation path.

By such a structure, a toner conveyance device of this invention does require neither the energy necessary for introducing air into the conveyance device at the time of conveying a toner fluid, nor the energy necessary for discharging air from a filter, although a conventional device does require it; therefore, the toner conveyance efficiency of the first conveyance means is enhanced, which makes it possible to carry out a long-distance conveyance of toner. Further, a toner conveyance device of this invention does not use a filter, which has been necessary in a conventional device, in the toner conveyance; therefore, it never occurs that a filter clogs up, and a stable toner conveyance is possible.

The control practiced by the control section 70 of a toner conveyance device of this invention will be explained with reference to the block diagram and the flow chart shown in FIG. 6 and FIG. 7 respectively.

Figure 6:
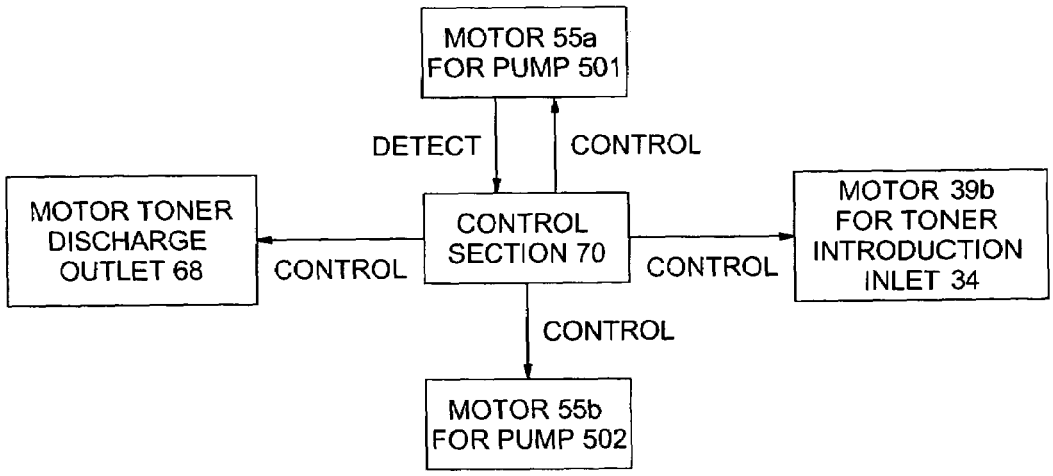
FIG. 6 is a block diagram showing an example of control of the first embodiment of a toner conveyance device of this invention.
Figure 7:
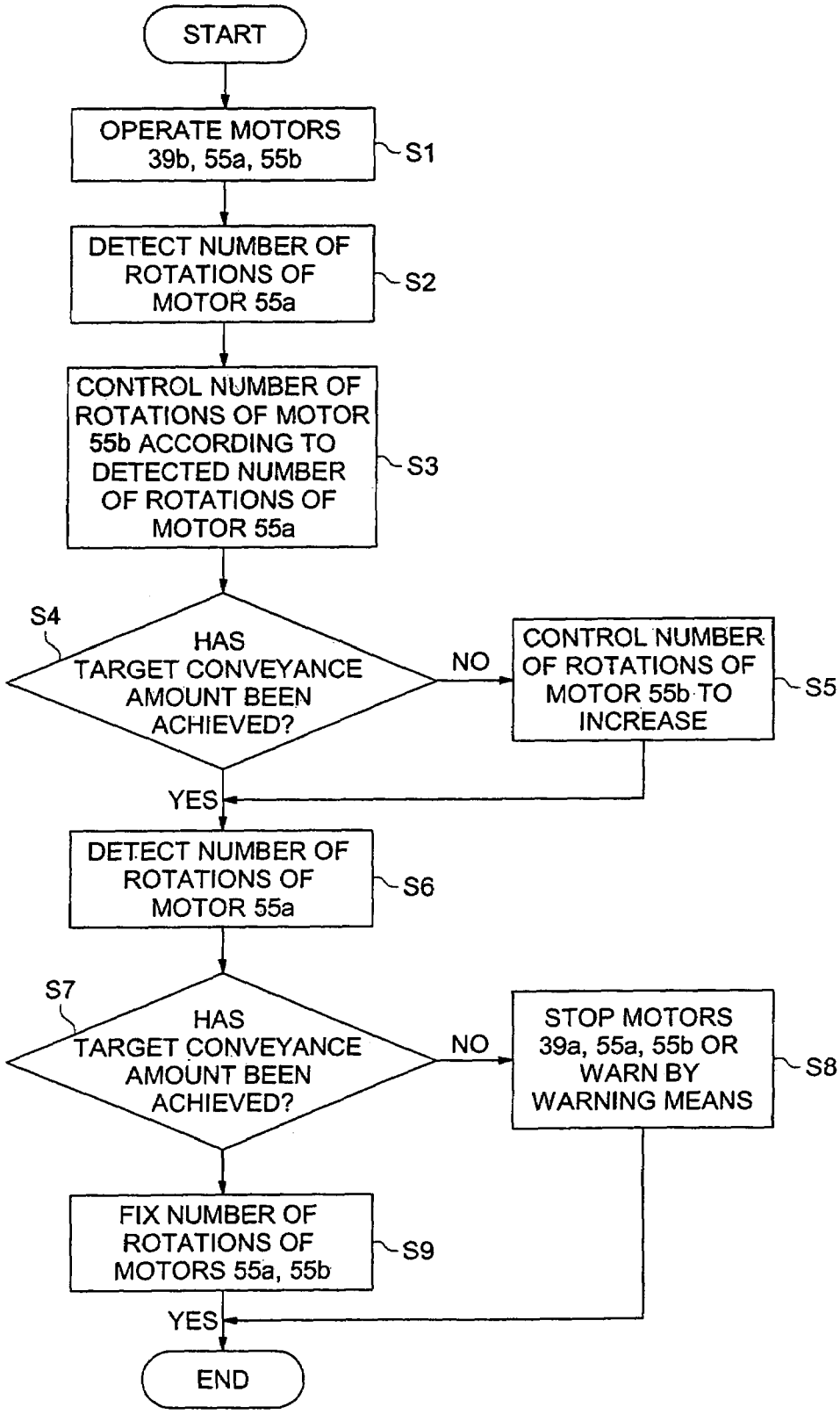
FIG. 7 is a flow chart showing an example of control of the first embodiment of a toner conveyance device of this invention.

As shown in FIG. 6, on the basis of a conveyance signal, the control section 70 practices a control to make the motor 39*b* operate at a set number of rotations so as to introduce toner particles into the toner mixing room 35. Further, the control section 70 practices a control to make the motor 55*a* of the pump 501 operate at a set number of rotations in order to convey toner particles from the toner mixing room 35, and further, practices a control to make the motor 55*b* of the pump 502 operate at a set number of rotations in order to convey air from the toner separation room 60.

Further, the control section 70 also carries out actually the detection of the number of rotations of the motor 55*a* of the pump 501. This is done for the reason that the number of rotations of the motor 55*a* of the pump 501 conveying a toner fluid actually tends to become lower than the set number of rotations of the motor because a load due to the toner fluid is produced. As regards the load due to the toner fluid, because it always fluctuates also in accordance with the environmental conditions (temperature, humidity, etc.), a correct value of the number of rotations can be obtained if it is detected every time as occasion demands.

Next, an explanation will be given with reference to the flow chart shown in FIG. 7.

First, the control section 70 makes the motor 39*b* at the toner introduction inlet 34, the motor 55*a* of the pump 501, and the motor 55*b* of the pump 502 operate, to start the conveyance of the toner fluid (S1).

The control section 70 detects the actual conveyance amount of the toner fluid by the pump 501 through detecting the number of rotations of the motor 55*a* of the pump 501 (S2).

The control section 70 controls the number of rotations of the motor 55*b* of the pump 502 on the basis of the detected conveyance amount of the toner fluid by the pump 501 (S3).

This control is done for the purpose of getting rid of the change of the pressure in the toner mixing room 35 and that in the toner separation room 60 during the toner conveyance as much as possible, and owing to this, it is possible to convey a toner fluid stably.

In this case, it is preferable that the control section 70 controls the number of rotations of the motor of the pump 502 in such a way as to make constant the ratio of the detected conveyance amount of toner fluid to the conveyance amount of air of the second conveyance means. By doing this, the change of the pressure in the toner mixing room 35 and that in the toner separation room 60 during the toner conveyance can be eliminated, and it is possible to convey a toner fluid stably.

Further, the control section 70 judges whether or not the conveyance amount of the toner fluid has reached the target conveyance amount (S4).

A target conveyance amount is a specified toner fluid amount to be conveyed by the first conveyance means, and usually is set at a value based on the necessary minimum amount of toner conveyed per unit time.

If the conveyance amount of the toner fluid has not reached the target conveyance amount, a control to increase the number of rotations of the motor 55*b* of the pump 502 is carried out (S5).

By doing this, because the pressure in the toner mixing room 35 is raised higher than the pressure in the toner separation room 60, the toner fluid is brought in a state of being pressed by the pump 501 from the toner mixing room due to the pressure difference. Accordingly, the toner fluid becomes easy to be conveyed to the toner separation room 60, which makes it possible to improve higher the conveyance efficiency of toner fluid by the pump 501.

This control is very effective in such a case that the number of rotations of the motor 55*a* of the pump 501 has reached upper limit and cannot be raised more; it actively uses the power source of the pump 502 for the conveyance of a toner fluid through the utilization of the tightly closed circulation path.

The control section 70 detects the conveyance amount of the toner fluid by detecting the number of rotations of the motor 55*a* of the pump 501 again (S6), and judges whether or not the conveyance amount of the toner fluid has reached a target conveyance amount (S7).

If the conveyance amount of the toner fluid has reached the target conveyance amount, the control section 70 carries out a control to fix the number of rotations of the motor 55*a* of the pump 501 and that of the motor 55*b* of the pump 502 (S9). If the conveyance amount of the toner fluid has not reached the target conveyance amount, the control section carries out a control to stop the motor 39*b* at the introduction inlet 34, the motor 55*a* of the pump 501, and the motor 55*b* of the pump 502, or carries out a control to issue a warning to the user by a warning means (a buzzer, a lamp, etc.) not shown in the drawing (S8). Further, it is also appropriate to carry out a control, if the conveyance amount of the toner fluid has not reached the target conveyance amount again, to repeat the steps S4 to S6 to increase the number of rotations of the motor 55*b* of the pump 502 more to make the conveyance amount reach the target amount.

Further, on the basis of the conveyance amount of the toner fluid of the pump 501, the control section 70 controls the toner supply amount to the toner mixing room 35 through the control of the number of rotations of the motor 39*b* at the toner introduction inlet 34. By doing this, because the amount of the toner for making a toner fluid at the time of toner conveyance can be made suitable, more stable toner conveyance becomes possible.

Further, on the basis of the conveyance amount of the toner fluid of the pump 501, the control section 70 controls the discharge amount of toner from the toner separation room 60 through the control of the number of rotations of the motor (not shown in the drawing) at the toner discharge outlet 68.

Further, it is desirable that the toner mixing room 35 and the toner separation room 60 have a toner detecting means such as the toner sensor 33 using a piezoelectric element for example; it is desirable that, in the case where the control section 70 detects that toner particles not less than a specified amount are accumulated in the toner mixing room 35 or the toner separation room 60, the control section 70 carries out a control to stop the motor 39*b*, motor 55*a*, or the motor 55*b*, or carries out a control to issue a warning to the user by a warning means (a buzzer, a lamp, etc.) not shown in the drawing.

By this invention, it has become possible to provide a toner conveyance device capable of carrying out a long-distance conveyance of toner over a long period of time and an image forming apparatus employing the toner conveyance device.

An example of the second embodiment of this invention will be explained with reference to the drawings. The points different from the above-mentioned first embodiment will be mainly explained in the following. In addition, the items having the same sign as those of the first embodiment have the same function as those.

Figure 8:
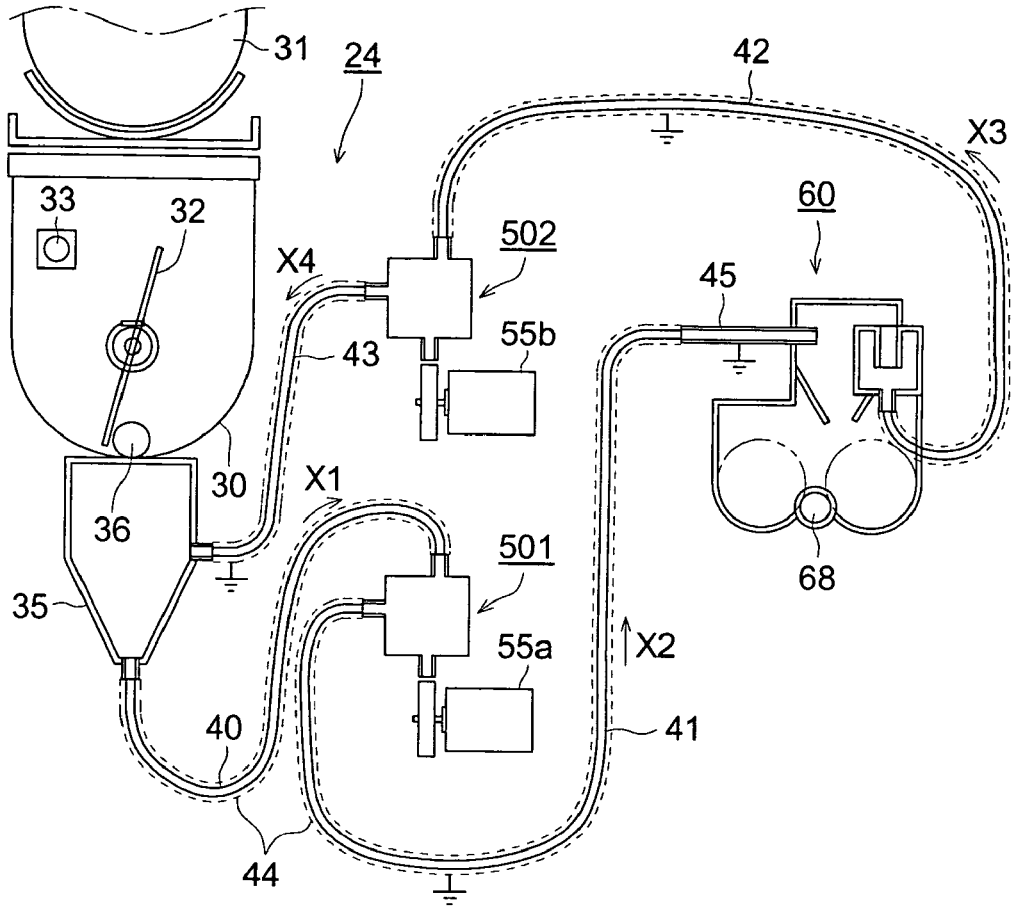
FIG. 8 shows an example of the second embodiment of the toner conveyance device of the image forming apparatus shown in FIG. 1.

The toner storage unit 24 shown in FIG. 8 is fitted with a toner container 31. The toner storage unit 24 comprises a toner hopper 30 and a funnel-shaped mixing room 35 for mixing toner particles with air, and a toner separation unit 60 arranged in the neighborhood of the development device and the toner storage unit 24 provided at a position distant from the development device 4 are connected by pipes 40 to 43, which are conveyance pipes. As regards the material of the pipes 40 to 43, at least a part of each of the pipes is a flexible member made of silicone rubber or fluorinated resin, and at least a part of each of the pipes is formed of a pipe made of metal.

Next, with reference to FIG. 8 and FIG. 9, a toner conveyance device will be explained.

Figure 9:
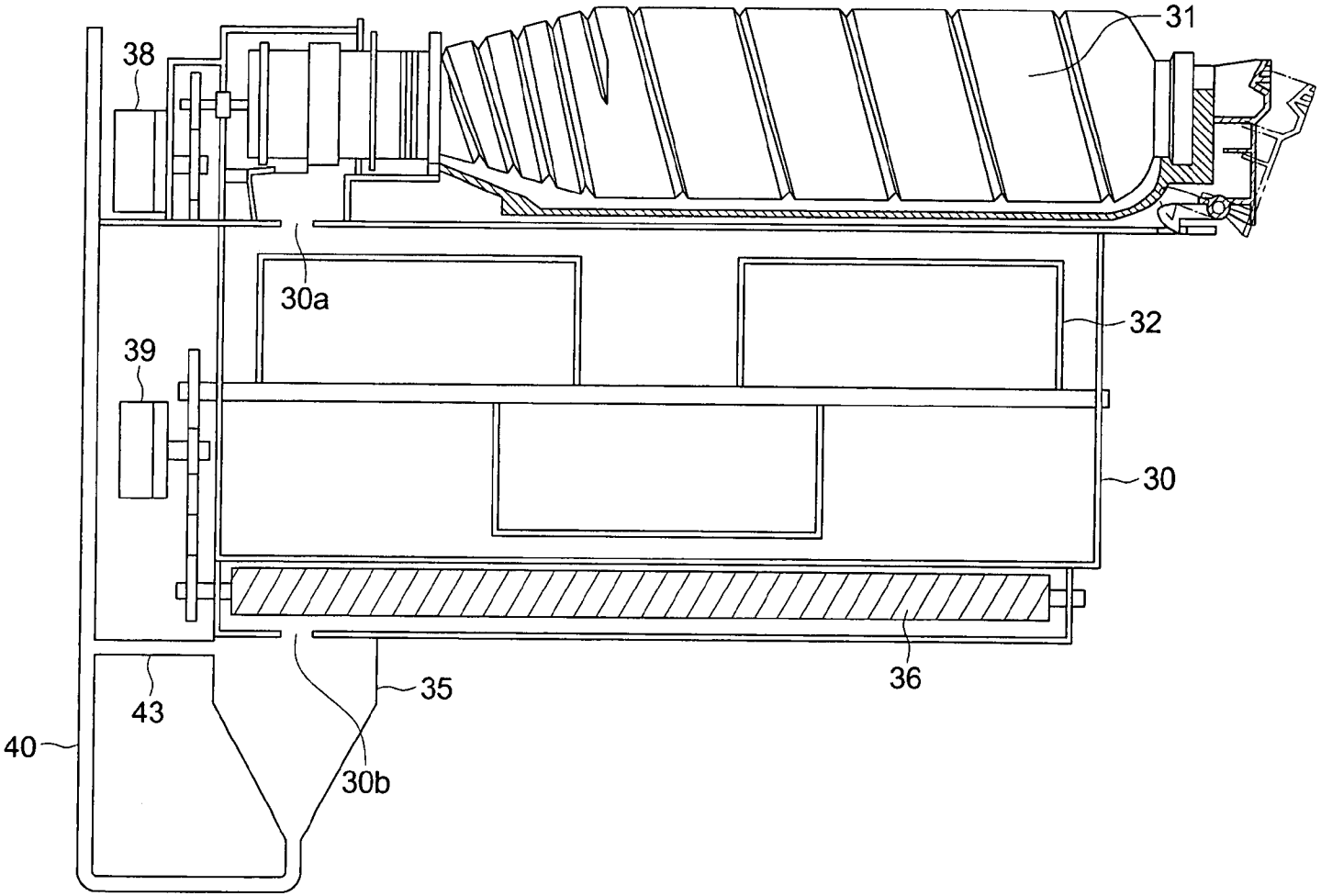
FIG. 9 shows a toner storage unit.

FIG. 8 shows the toner conveyance device of the image forming apparatus shown in FIG. 1, and FIG. 9 shows the toner storage unit.

The toner conveyance device consists of the toner storage unit 24, pumps 501 and 502 as a toner supply means and a fluid conveyance means for toner circulation respectively, the toner separation unit 60, the pipes 40 to 43 to become a toner conveyance path, etc.

In FIG. 9, the toner storage unit is fitted with the cylindrical toner container 31, and by the driving of the toner container 31 to rotate by a motor 38, toner particles drop from the toner container 31 through an opening 30*a* to the toner hopper 30. In the toner hopper 30, there is provided a bar-shaped stirring member 32 having a plurality of U-shaped portions formed, and in the lower part of the toner hopper 30, a conveyance screw 36 is provided.

The stirring member 32 and the screw 36 are rotated by the rotation of a motor 39, and toner particles drop from the toner hopper into the mixing room 35 through an opening 30*b*.

In the mixing room 35, because air is fed in through the pipe 43 as will be described later, a fluid composed of toner particles mixed with air is formed.

Figure 10:
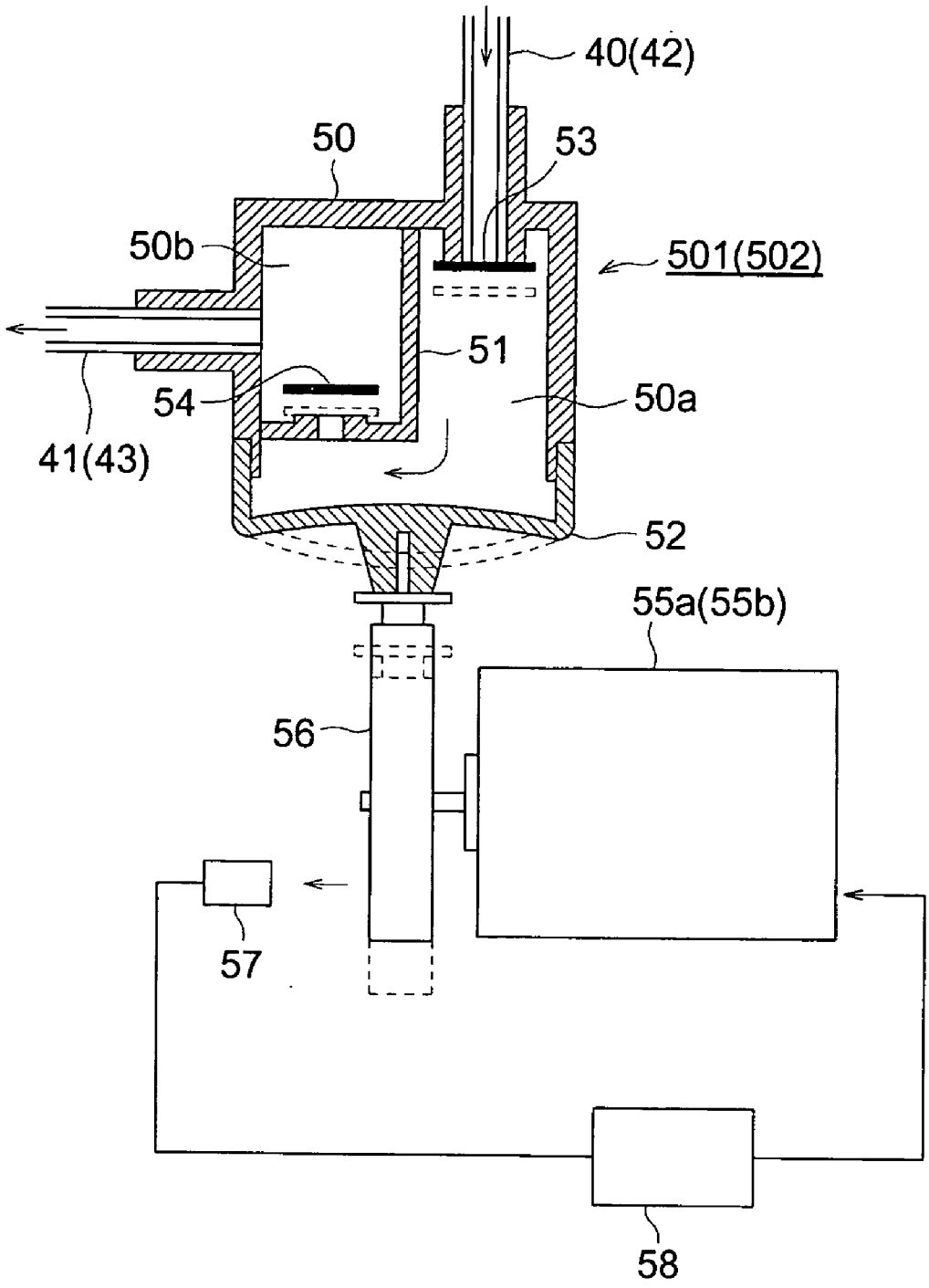
FIG. 10 is a cross-sectional view of the structure of a diaphragm pump.

FIG. 10 is a cross-sectional view of the structure of a diaphragm pump.

Heretofore, it has sometimes occurred a case where the pressure balance between a portion toward the pipe 41 and a portion toward the pipe 42 was broken due to the fluctuation of the number of rotations of the pump motor 55*a* (55*b*) etc., and in order to reduce this pressure change, a filter was used in the toner separation unit 60 and a part of air was made to flow out to the outside for the adjustment of the air pressure. However, as described before, the filter clogged up in its early stage of use, which generated toner scattering, and a troublesome operation, a periodical replacement of the filter was required.

The first structure of the second embodiment of this invention is characterized by a device structure not requiring the above-mentioned troublesome operation such as a replacement of the filter.

That is, in the supply path and circulation path of toner which is brought in a stage of being tightly closed against the outside air, the pump motor 55*a* (55*b*) has its number of rotations detected, for example, by an optical rotation counter 57 as a detection means, and is controlled to have a specified number of rotations by a controller 58; this produces a smooth air flow, which makes it possible to keep constant the pressure in the supply path and the circulation path of toner, and makes it possible to get rid of a filter which has been necessary for the adjustment of pressure difference from the outside air. The ratio of the number of rotations of the pump motor 55*a* to the number of rotations of the pump motor 55*b* is determined to have a value to make the suction amount and discharge amount approximately the same for both the pump motors on the basis of data obtained beforehand by an experiment, and in accordance with a program for the above-mentioned ratio of the number of rotations, the pump motor 55*a* and 55*b* rotate in response to the instruction from the controller 58.

Next, the toner separation unit 60 will be explained.

Figure 11:
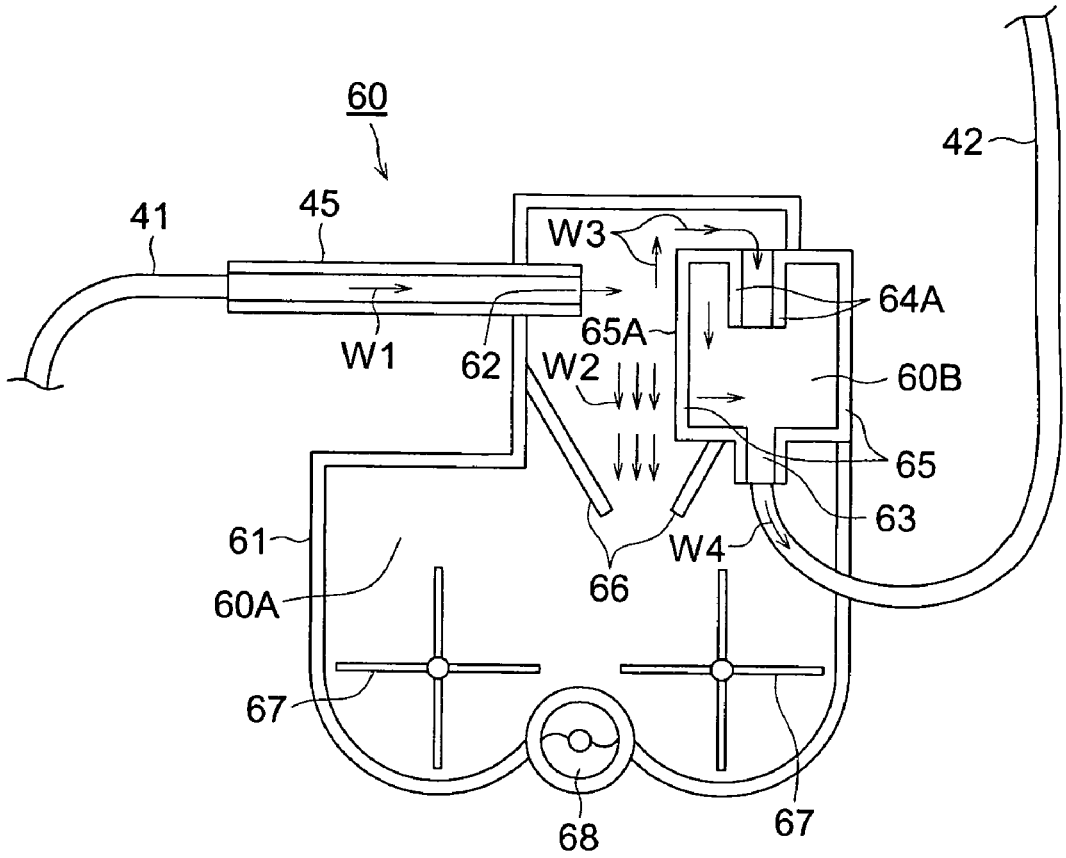
FIG. 11 is a cross-sectional view showing the structure of a toner separation unit.

FIG. 11 is a cross-sectional view showing the structure of the toner separation unit.

As shown in FIG. 8, the mixing room 35, the pumps 501 and 502, and the toner separation unit 60 are connected by the pipes 40, 41, 42, and 43 to one another.

By the pump 501, a mix fluid is conveyed from the mixing room 35 to the pump 51 as shown by the arrow mark X1, and from the pump 501 to the toner separation unit 60 as shown by the arrow mark X2, to carry out a toner supply; further, the air flows back from the separation unit 60 to the pump 502 as shown by the arrow mark X3, and from the pump 502 to the mixing room 35 as shown by the arrow mark X4. Then, toner particles are separated in the toner separation room 60, and are supplied to the development device 4 (refer to FIG. 1) by the screw 68.

The second structure of the second embodiment of this invention is characterized by an improved effect of the toner conveyance brought about by it that, for the purpose of preventing the trouble of the conveyance of toner particles being obstructed owing to the toner adherence to the inner surface of the pipe caused by the charging of toner particles due to frictional electrification during the conveyance of toner through the pipe, the pipe is made of a resin having an electric resistivity not greater than a specified value, round the outside of which a metallic grounding member 44 is wound, and a metallic pipe 45 is used in the intermediate path and is grounded.

The toner conveyance device shown in FIG. 8 to FIG. 11 operates in the following way.

The toner amount in the toner hopper 30 is detected by a toner sensor 33, and if the level of the toner pile becomes lower than the level capable of being detected by the toner sensor 33, a motor 38 operates to cause toner to be supplied from a toner container 31 to the toner hopper 30.

In accordance with a toner supply signal to supply toner to the development device 4 issued from a control means (not shown in the drawing), a motor 39 shown in FIG. 9 operates to drive a stirring member 32 to stir toner particles in the toner hopper 30, while it drives a screw 36 to make toner particles drop into the mixing room 35. In accordance with the above-mentioned toner supply signal, the pump motors 55*a* and 55*b* operate to actuate pumps 501 and 502 respectively. By the operation of the pumps 501 and 502, an air flow is generated in the mixing room 35 by which the toner particles are mixed with air, and the mixed fluid is conveyed through the pipes 40 and 41 to the toner separation unit 60 by the conveyance force of the pump 501.

The toner particles separated in the toner separation unit 60 are supplied to the development device 4 by the screw 68. Further, the mix fluid composed of toner particles remaining not separated and air is made to flow back through the pipes 42 and 43 to the mixing room 35 by the conveyance force of the pump 502.

By a control to make the pump motor for actuating the pump of the fluid conveyance means for toner supply and that for actuating the pump of the fluid conveyance means for toner circulation each have a specified number of rotations, it becomes possible that the pressure change in the toner conveyance path which is tightly closed against the outside air is reduced, and toner particles are conveyed smoothly; therefore, a filter as used conventionally which causes toner scattering to occur becomes unnecessary, and troublesome operations such as a replacement of the filter at the time of maintenance work can be omitted.

Further, by the countermeasure for preventing the charging of the pipes using a grounding member, a smooth toner conveyance becomes possible.

What is claimed is:

1. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit;

a tightly closed circulation oath for the air, which starts at the toner mixing unit, leads to the toner separation unit through the first conveyor, and returns to the toner mixing unit through the second conveyor; and a controller for detecting a conveyance amount of the toner fluid by the first conveyor and controlling a conveyance amount of the air by the second conveyor based on the conveyance amount of the toner fluid.

2. The toner conveyance device of claim 1, wherein the controller controls a ratio of the conveyance amount of the toner fluid to the conveyance amount of the air by the second conveyor to be constant.

3. The toner conveyance device of claim 1, wherein when the conveyance amount of the toner fluid is not greater than a target conveyance amount, the controller increases the conveyance amount of the air by the second conveyor.

4. The toner conveyance device of claim 1, wherein when the conveyance amount of the toner fluid is not greater than a target conveyance amount, the controller stops the first conveyor and the second conveyor.

5. The toner conveyance device of claim 1, further comprising a warning device for giving a warning when the conveyance amount of the toner fluid is not greater than a target conveyance amount.

6. The toner conveyance device of claim 1, wherein the controller controls a toner introduction amount by the toner introducing portion based on the conveyance amount of the toner fluid by the first conveyor.

7. An image forming apparatus comprising the toner conveyance device as set forth in claim 1.

8. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor, which comprises a pump motor, for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor, which comprises a pump motor, for conveying the air separated by the toner separation unit back to the toner mixing unit;

a tightly closed circulation path for the air, which starts at the toner mixing unit, leads to the toner separation unit through the first conveyor, and returns to the toner mixing unit through the second conveyor; and a controller which respectively detects and controls a number of rotations of each said pump motor of the first conveyor and the second conveyor.

9. An image forming apparatus comprising the toner conveyance device as set forth in claim 8.

10. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit; and a tightly closed circulation oath for the air, which starts at the toner mixing unit, leads to the toner separation unit through the first conveyor, and returns to the toner mixing unit through the second conveyor;

wherein each of the first conveyor and the second conveyor has a conveyance path of toner particles, at least a part of each said conveyance path is formed by a flexible pipe at least partially made of one of resin and rubber, and a metal member is wound around an outer surface of at least a part of the flexible pipe, and the metal member is grounded.

11. The toner conveyance device of claim 10, wherein at least a part of the flexible pipe is made of metal grounded.

12. The toner conveyance device of claim 10, wherein at least a part of the flexible pipe is made of one of silicone rubber and fluorinated resin.

13. An image forming apparatus comprising the toner conveyance device as set forth in claim 10.

14. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit; and a tightly closed circulation path for the air, which starts at the toner mixing unit, leads to the toner separation unit through the first conveyor, and returns to the toner mixing unit through the second conveyor;

wherein the toner mixing unit comprises a toner detector for detecting an amount of toner therein, and when the toner detector detects that an amount of toner accumulated in the toner mixing unit exceeds a prescribed amount, a controller stops the first conveyor and the second conveyor.

15. An image forming apparatus comprising the toner conveyance device as set forth in claim 14.

16. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit; and a tightly closed circulation oath for the air, which starts at the toner mixing unit, leads to the toner separation unit through the first conveyor, and returns to the toner mixing unit through the second conveyor;

wherein the toner mixing unit comprises a toner detector for detecting an amount of toner therein, and when the toner detector detects that an amount of toner accumulated in the toner mixing unit exceeds a prescribed amount, a controller gives a warning.

17. An image forming apparatus comprising the toner conveyance device as set forth in claim 16.

18. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit; and a tightly closed circulation oath for the air, which starts at the toner mixing unit, leads to the toner separation unit through the first conveyor, and returns to the toner mixing unit through the second conveyor;

wherein the toner separation unit comprises a toner detector for detecting an amount of toner therein, and when the toner detector detects that an amount of toner accumulated in the toner separation unit exceeds a prescribed amount, a controller stops the first conveyor and the second conveyor.

19. An image forming apparatus comprising the toner conveyance device as set forth in claim 18.

20. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit; and a tightly closed circulation oath for the air, which starts at the toner mixing unit, leads to the toner separation unit through the first conveyor, and returns to the toner mixing unit through the second conveyor;

wherein the toner separation unit comprises a toner detector for detecting an amount of toner therein, and when the toner detector detects that an amount of toner accumulated in the toner separation unit exceeds a prescribed amount, a controller gives a warning.

21. An image forming apparatus comprising the toner conveyance device as set forth in claim 20.

22. A toner conveyance device for conveying toner particles, comprising:

a toner mixing unit which includes a toner introducing portion to introduce toner particles, and which mixes the toner particles introduced from the toner introducing portion with air to make a toner fluid;

a first conveyor for receiving the toner fluid produced in the toner mixing unit and conveying the toner fluid;

a toner separation unit which separates the toner fluid conveyed by the first conveyor into the air and the toner particles, and which includes a toner discharging portion for discharging the separated toner particles;

a second conveyor for conveying the air separated by the toner separation unit back to the toner mixing unit; and a tightly closed circulation path for the air, which starts at the toner mixing unit, leads to the toner separation unit through the first conveyor, and returns to the toner mixing unit through the second conveyor;

wherein the toner separation unit comprises a through passage for causing the toner fluid to meander.

23. An image forming apparatus comprising the toner conveyance device as set forth in claim 22.

* * * * *